US005138950A

United States Patent [19]

Gardner et al.

[11] Patent Number: 5,138,950

[45] Date of Patent: Aug. 18, 1992

[54] WATER RESISTANT TOP WAD FOR SHOTSHELLS

[75] Inventors: Robert J. Gardner, Bethalto, Ill.; Morris C. Buenemann, Jr., Florissant, Mo.

[73] Assignee: Olin Corporaton, Cheshire, Conn.

[21] Appl. No.: 787,176

[22] Filed: Nov. 4, 1991

[51] Int. Cl.[5] ..... F42B 7/08; F42B 7/12

[52] U.S. Cl. ..... 102/462; 102/456

[58] Field of Search ..... 102/462, 456, 461, 466

[56] References Cited

U.S. PATENT DOCUMENTS

| | | | |
|---|---|---|---|
| 2,818,810 | 1/1958 | Reynolds | 102/462 |
| 2,986,998 | 6/1961 | Clark | 102/461 |
| 3,022,734 | 2/1962 | Kidder | 102/461 |
| 3,205,819 | 5/1964 | Barrick | 102/462 |
| 3,352,239 | 11/1967 | Schinnerer et al. | 102/462 |
| 3,596,600 | 8/1971 | Himmetsbach | 102/462 |
| 3,673,965 | 7/1972 | Herter | 102/451 |
| 3,760,729 | 9/1973 | Freeman | 102/466 |
| 4,991,512 | 2/1991 | Van Wyk | 102/462 |

FOREIGN PATENT DOCUMENTS

| | | | |
|---|---|---|---|
| 1105279 | 11/1955 | France | 102/462 |
| 706560 | 5/1966 | Italy | 102/462 |
| 998134 | 7/1965 | United Kingdom | 102/462 |

*Primary Examiner*—David H. Brown
*Attorney, Agent, or Firm*—John R. Wahl

[57] ABSTRACT

A moisture seal over shot wad for a roll crimped shotshell casing. The seal has a pair of spaced tubular flanges which comprise the rim portion of the disk shaped over shot wad. The tubular flanges are designed to receive the terminal end of the shotshell casing as the roll crimp is formed to frictionally engage the terminal end and seal the casing against the intrusion of moisture.

8 Claims, 2 Drawing Sheets

WATER RESISTANT TOP WAD FOR SHOTSHELLS

BACKGROUND OF THE INVENTION

1. Field of the Invention

This invention generally relates to shotshells and more particularly to a top wad moisture seal for a shotshell having a roll crimp end closure.

2. Description of the Related Art

A roll crimp end closure for a shotshell typically involves placing a paper, plastic, or metal disk over the load of shot in the shotshell and then rolling the end of the shotshell tube down onto the disk.

An example of this type of end closure is disclosed in U. S. Pat. No. 2,818,810 to Reynolds. The closure disk described in this patent is a circular disk having an approximately semi-circular, axially extending peripheral flange. Upon muzzle exit, this flange causes the closure disk to separate away from the shot so as not to impede the trajectory of the shot column.

Another type of end closure is described in U.S. Pat. No. 3,205,819 to Barrick. This patent discloses an over shot wad which has as a circumferential groove formed in a perimeter edge thereof defining a pair of pliable lips. This wad eliminates the necessity for a roll crimp to retain the wad on top of the shot. The lips are elastically compressed against the inside wall of the tube to secure the wad in place against the shot thus closing the end of the shotshell. The over shot wad is relatively thick in order to support the two lips and is therefore a substantial parasitic mass. In addition, it has a flat disk shape which can impede the down range trajectory of the shot column upon leaving the gun muzzle.

U.S. Pat. No. 3,352,239 to Schinnerer et al discloses a over shot wad for a roll crimp shotshell that has a flat circular disk portion with a peripheral tubular portion. The plastic wad is placed inside the case over the load of shot and the case roll crimped over the tubular portion to hold the wad in place. The wad may have a central portion of reduced and raised thickness to constitute tactile markings to indicate such things as the buck shot size.

U.S. Pat. No. 3,596,600 discloses a plastic shotshell with a plastic disk over shot wad which has a dome shape and resiliently snaps over center into place in an appropriately sized groove molded into the inside wall at the end of the shotshell casing. The disk in this case is snapped over center from a convex outward configuration to a concave outward configuration to snap fit the disk in place.

U.S. Pat. No. 3,673,965 to Herter discloses an over shot wad having a generally disk shape with a thickened rim portion and thickened central hub portion. In addition, radial spokes from the hub to the rim provide addition stiffness to the top wad. The mouth of the shotshell is bent inward to form a resilient bead or lip retainer to retain the top wad in place. This shot wad is made of a soft unbreakable polyethylene material which stays in one piece. Reliance is made on wind catching the radial ribs as pressure veins to clear the over shot wad from the path of the shot charge.

None of these patents discloses a moisture resistant over shot top wad which precludes moisture intrusion during normal field handling of the shotshell. A novel approach to sealing shotshells is disclosed in U.S. Pat. No. 4,991,512 issued to Van Wyk and assigned to the assignee of the present invention. The moisture seal disclosed in this patent is a composite disk of a thermally conductive layer and a thermoplastic layer such as high density polyethylene laminated together. The rim portion of the high density polyethylene layer is bonded or fused to the tubular casing to render the casing impervious to moisture. This moisture seal is very thin and light weight and thus is not preferably designed to be the only end closure member. The seal described in this patent is designed to be positioned over or under the normal end closure such as a star folded or roll crimp.

The deleterious effects of water intrusion into a shotshell can be quite serious. If water seeps into the shot load and is trapped inside for a period of time, it will rust the steel shot and may fuse the shot together into a single mass. In addition, if water gets into the propellant, a "squib" may be produced which could conceivably destroy the gun upon firing of a subsequent round.

Accordingly, there is still a need for a moisture resistant shotshell top wad which can be readily inserted without regard to orientation, provides a good moisture seal, is adapted for use with standard roll crimp tooling, and which has minimal effect on the shot pattern.

SUMMARY OF THE INVENTION

The moisture resistant top wad in accordance with the present invention is a thermoplastic disk having a tubular rim and a pair of oppositely opening axial annular channels in the rim portion. One of these channels receives and holds the curled over terminal end of the Reifenhauser tube of the shotshell during formation of the roll crimp.

In its simplest form, the invention is a unitary plastic disk shaped body having an annular rim adapted to receive a roll crimped terminal end of a plastic shotshell. The rim portion of the wad has a pair of concentric tubular flanges which are spaced from one another by a distance that is approximately equal to the thickness of the shotshell case. As the roll crimp at the end of the shot shell tube is formed, the terminal end of the casing is guided into the space between the two concentric flanges by a tapered terminal lip on each of the flanges. The over shot top wad, according to the present invention, is symmetrically designed so that it may be placed in the end of the shotshell without regard to front/back orientation.

The terminal lip on each of the outer flanges of the over shot wad is outwardly extending and is flexible so that when the wad is inserted in the casing it is resiliently compressed against the walls of the tube to provide a positive seal against the inside surface of the tubular case. Each of the inner flanges also has a tapered lip designed to guide insertion of the terminal end of the casing into the space between the flanges as the roll crimp is formed.

Further features and advantages of the invention will become apparent upon a reading of the following detailed description and claims when taken in conjunction with the accompanying drawings.

DETAILED DESCRIPTION OF THE INVENTION

Figure 1:
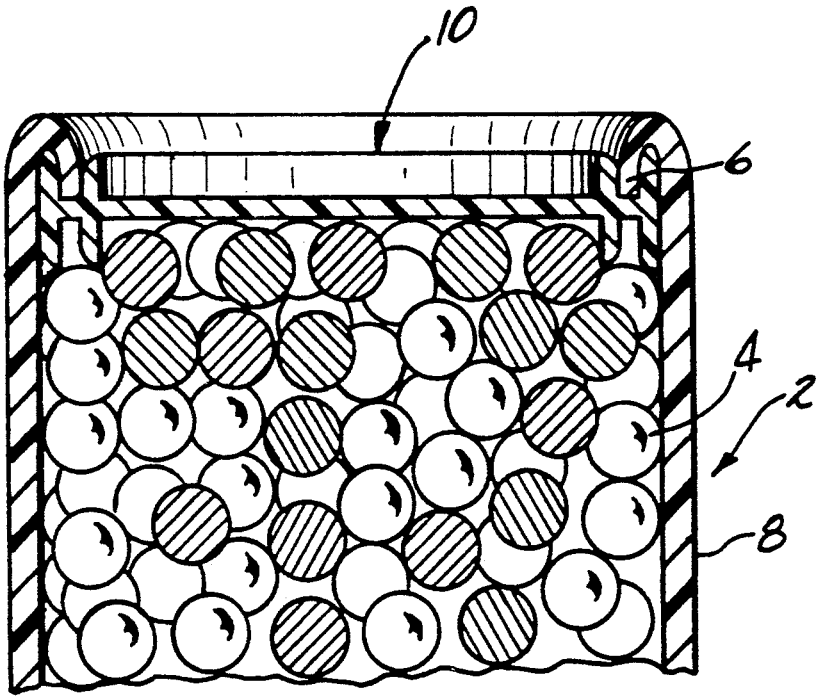
FIG. 1 is a partional longitudinal sectional view through a shotshell in accordance with the present invention.

A shotshell having a moisture resistant end closure in accordance with the present invention as illustrated in FIG. 1. The shotshell 2 has a shot load 4 in one end 6 of the tubular casing 8. Over the shot load 4 is positioned a top wad 10 in accordance with the present invention. The end 6 of the shotshell casing 8 is rolled over into a space between two concentric tubular flanges of the top wad 10 as will be subsequently described. Thus the terminal end 6 of the casing 8 is securely held in place and sealed against the intrusion of moisture.

Figure 2:
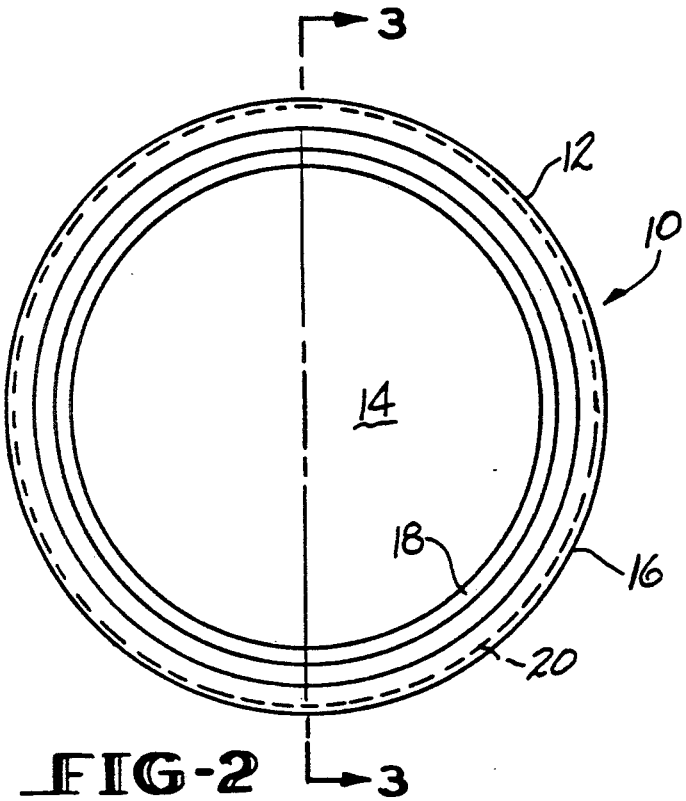
FIG. 2 is a top view of a wad in accordance with the present invention.
Figure 3:
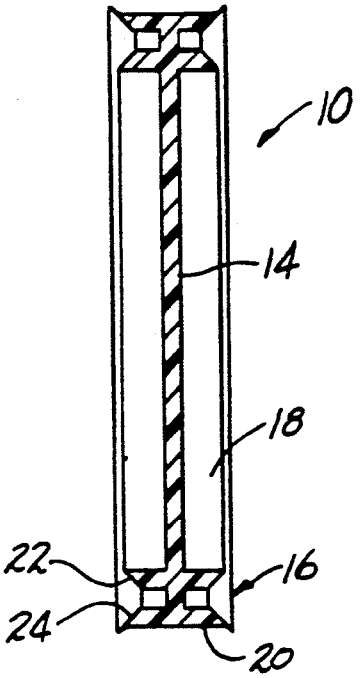
FIG. 3 is a cross sectional view of the wad in accordance with the present invention taken along the line 3—3 in FIG. 2.

The top wad 10 in accordance with the present invention shown separately in FIGS. 2 and 3, comprises a generally disk shaped body 12 which has a central portion 14 which has a generally disk shape and a annular rim portion 16. The rim portion 16 is essentially a pair of concentric tubular inner and outer flanges 18 and 20 respectively.

Each of the axially extending flanges 18 and 20 has a tapered lip, preferably extending at an angle of about 45°, to guide insertion of the terminal end 6 of the casing 8 as the roll crimp on the shotshell 2 is formed. The spacing between the flanges 18 and 20 is chosen so as to frictionally grip the terminal end 6 of the casing.

In addition, the outer lip 24 has a greater terminal diameter than the diameter of flange 20 so that the outer lip is resiliently compressed upon insertion into the shotshell casing. Thus, this outer lip 24 provides an additional seal between the wad and the casing in addition to the frictional seal provided between the flanges 18 and 20 at the roll crimped end 6.

As shown in FIG. 3, the rim portion is symmetrically bisected by central portion 14 creating two sets of flanges 18 and 20. Both sides of the wad 10 are preferably identical so that positioning of the wad within the shotshell casing is independent of orientation.

Figure 4:
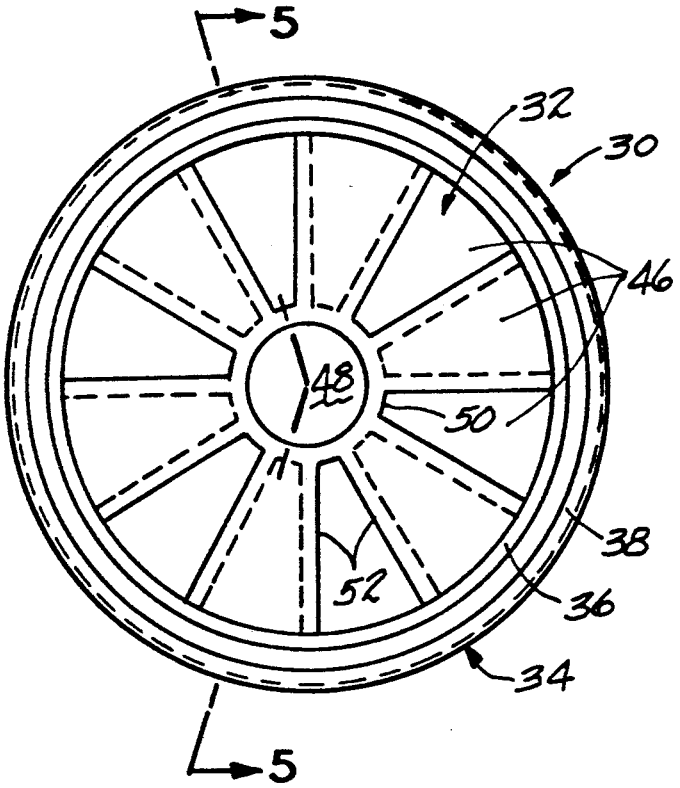
FIG. 4 is a top view of an alternate preferred embodiment of the wad in accordance with the present invention.
Figure 5:
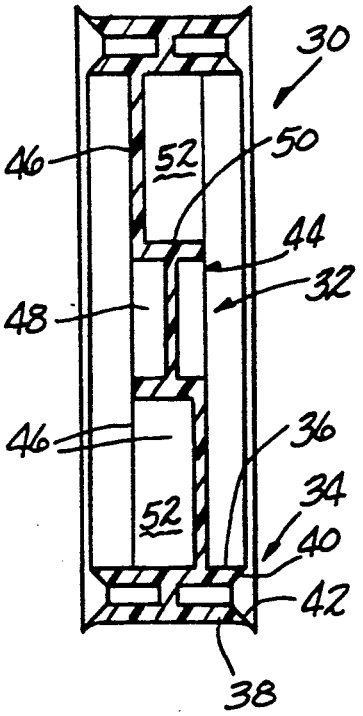
FIG. 5 is a cross sectional view of the wad in accordance with the present invention illustrated in FIG. 4 taken on the line 5—5.

An alternate preferred embodiment 30 of the invention is shown in FIGS. 4 and 5. The rim portion of this alternative embodiment is similar to that previously described. Body 30 again comprises a central portion 32 and a rim portion 34. Rim portion 34 comprises a pair of inner and outer flanges 36 and 38 which have tapered inner and outer lips 40 and 42 respectively. The inner and outer flanges 36 and 38 operate as previously described in the discussion of the first embodiment.

The central portion 32 comprises a central hub 44 and a plurality of segments 46 which radiate from the hub to the rim portion 34. Hub 44 comprises a transverse wall 48 which bisects a tubular wall 50. Extending radially outward from tubular wall 50 to the rim portion 34 are a plurality of spaced ribs 52. These ribs 52 are flat radial sections having the same width as the length of tubular wall 50 and extend axially between and connect adjacent segments 46. Segments 46 extend from tubular wall 50 to rim portion 34 and join with ribs 52 in an alternating manner such that adjacent segments 46 are connected to opposite sides of ribs 52 and the opposite ends of tubular wall 50. There are preferably an even number of segments 46, with an equal number extending from each end of tubular wall 50 to maintain symmetry.

The over shot top wads 10 and 30, are injection molded. Weld lines are formed where the injected melt meets during injection molding. These weld lines are fracture propagation sites. Formation of weld lines is enhanced by providing thin walled regions in the disk. Separation of the top wad 10 into fragments is preferably assured by providing one or more radial grooves 26 in disk portion 14. These grooves are preferably back to back and have a wall thickness of about 0.010 at the bottom. The grooves 26 are preferably wide bottomed, having a bottom width of between about 0.020 inches and 0.025 inches.

Especially in the embodiment shown in FIGS. 4 and 5, the tortuous path that the melt must follow results in a large number of weld lines being formed primarily in the thin walled segments 46. The melt injected in the center of transverse wall 48 preferentially flows through the thicker portions i.e. hub tubular wall 50 and radially extending ribs 52 before entering and joining together forming weld lines in the thin regions. The large number of weld lines generated using the configuration shown in FIG. 4 results in a large number of crack initiation sites which enhances the frangibility of the wad upon shot load exit from the shot gun muzzle.

A relatively brittle injection molded plastic material with a very high melt flow rate must be utilized to form the wad in accordance with the present invention. An example is a polypropylene material having a melt flow rate of about 30 or greater as measured by ASTM D1238 Condition L.

It is highly desirable that the wad disintegrate upon firing so as to have minimal effect on the down range shot pattern. Accordingly, either maximizing the number of weld lines to increase the probability of crack initiation and propagation or providing transverse grooves or channels to provide weakened areas in the disk shaped central portion may be advantageously utilized to ensure frangibility. Typically the wall thickness of the central portion 14 and the segments 46 and hub 44 is about 20 mils or less. This thickness is sufficient to retain the shot during normal handling and thin enough to ensure rapid fracture and separation of the wad fragments upon muzzle exit.

While the invention has been described above with reference to specific prefered embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. An over shot wad for providing a moisture proof seal on a roll crimped shotshell comprising:

a unitary plastic disk shaped body having a central portion and having an annular rim portion, said rim portion having at least one pair of concentrically spaced annular flanges adapted to receive a roll crimped terminal end of a plastic shotshell casing therebetween, each of said flanges terminating in a tapered lip so as to guide said terminal end between said flanges, said lip on the outer flange of said pair of flanges extending to a diameter greater than said outer flange.

2. The wad according to claim 1 wherein said central portion is a thin flat disk of plastic terminating in said rim portion.

3. The wad according to claim 1 wherein said rim portion further comprises another pair of concentrically spaced annular flanges extending axially opposite said one pair of flanges.

4. The wad according to claim 3 wherein said another pair of flanges is identical to said one pair of flanges.

5. An over shot wad for providing a moisture proof seal on a roll crimped shotshell comprising:

a unitary plastic disk shaped body having a central portion and having an annular rim portion, said rim portion having at least one pair of concentrically spaced annular flanges adapted to receive a roll crimped terminal end of a plastic shotshell casing therebetween, at least one of said flanges terminating in a tapered lip so as to guide said terminal ends between said flanges, wherein said central portion comprises a center hub having a transverse wall bisecting a tubular wall and plurality of wedge shaped segments connecting said hub with said rim.

6. The wad according to claim 5 wherein circumferentially adjacent segments extend to said rim portion from said hub from opposite ends of said tubular wall.

7. The wad according to claim 5 wherein each of said segments is connected to an adjacent segment by an intregral radial web extending between said hub and said rim portion.

8. A moisture resistant shotshell having a tubular plastic casing and a shot load therein at one end of said casing, a plastic wad over said load and a roll crimp at said end, the improvement comprising said wad having a pair of tubular flanges extending from a rim portion of said wad sandwiching said roll crimped end therebetween, an outer of said flanges having a tapered lip extending to a diameter greater than said outer flange resiliently compressed against an inside surface of said casing.

* * * * *